US006851571B1

(12) United States Patent
LaLonde

(10) Patent No.: US 6,851,571 B1
(45) Date of Patent: Feb. 8, 2005

(54) HOLDER FOR ASSISTING IN HOLDING PAINT CONTAINER

(75) Inventor: Joseph R. LaLonde, Birmingham, MI (US)

(73) Assignee: The Painter's Thumb, LLC, Metamora, MI (US)

( * ) Notice: Subject to any disclaimer, the term of this patent is extended or adjusted under 35 U.S.C. 154(b) by 31 days.

(21) Appl. No.: 09/910,114

(22) Filed: Jul. 20, 2001

(51) Int. Cl.[7] ..... B65D 25/10

(52) U.S. Cl. ..... 220/756; 220/755; 220/757; 220/759; 220/760

(58) Field of Search ..... 220/756, 755, 220/757, 759, 760, 752, 754, 750

(56) References Cited

U.S. PATENT DOCUMENTS

| | | | | |
|---|---|---|---|---|
| 986,660 A | | 3/1911 | Weathers | |
| 1,348,516 A | | 8/1920 | Peck | |
| 1,953,933 A | | 4/1934 | Gundelach | |
| 2,511,537 A | | 6/1950 | Migdow | |
| 2,661,858 A | | 12/1953 | Howell | |
| 2,669,736 A | | 2/1954 | Wabnitz | |
| 3,419,196 A | * | 12/1968 | Moore | 119/72 |
| 4,702,395 A | | 10/1987 | Nitsch | |
| 4,736,488 A | | 4/1988 | Nielsen | |
| 4,846,100 A | | 7/1989 | Montoya | |
| 4,927,046 A | | 5/1990 | Armstrong | |
| 5,092,481 A | * | 3/1992 | Skelton | 220/751 |
| 5,186,507 A | | 2/1993 | Neidfeld | |
| 5,570,807 A | * | 11/1996 | Busch | 220/755 |
| 5,634,568 A | | 6/1997 | Wawrzyniak | |
| 6,101,628 A | | 8/2000 | Earl | |

* cited by examiner

*Primary Examiner*—Joseph Man-Fu Moy
(74) *Attorney, Agent, or Firm*—Bliss McGlynn, P.C.

(57) ABSTRACT

A holder for assisting in holding a paint container includes a sleeve adapted to receive a thumb of a hand. The holder also includes a retainer connected to the sleeve adapted to retain a handle of a paint container and allow a weight of the paint container to be transferred to a remainder of the hand supporting a bottom of the paint container.

15 Claims, 2 Drawing Sheets

HOLDER FOR ASSISTING IN HOLDING PAINT CONTAINER

BACKGROUND OF THE INVENTION

1. Field of the Invention

The present invention relates generally to paint containers and, more particularly, to a holder for assisting in holding a paint container such as a metal one gallon bucket.

2. Description of the Related Art

It is known to provide a container for holding paint used in painting objects. Typically, the paint container is a can or bucket containing paint and having a metal handle for carrying the paint container. However, painters' are known to hold the paint container by the handle in the down position while painting an object with a paintbrush. When this occurs, it becomes difficult to hold the paint container with the person's hand.

One attempt to hold the paint container is with the palm of the hand supporting the bottom of the paint container. However, one needs to put less paint in the paint container, which is undesired. Another attempt to hold the paint container is with the palm of the hand supporting the bottom of the paint container and the thumb of the hand being wrapped around the metal handle of the paint container to stabilize the paint container. While more paint can be held in the paint container, a sufficient force is placed directly on the thumb, resulting in pain over time.

One attempt to eliminate the pain is to wear a glove over the hand. However, the glove tends to cut off circulation to the thumb of the hand. In addition, another attempt to eliminate the pain is to have a plastic sleeve over the metal handle, however, this still results in thumb pain over time.

Therefore, it is a desirable to provide a holder for assisting in holding a paint container that is comfortable to the thumb. It is also desirable to provide a holder for assisting in holding a paint container that allows a person to hold more paint and to put a paint container down quickly. It is further desirable to provide a holder for assisting in holding a paint container, which is cheap and easy to use. Therefore, there is a need in the art to provide a holder for assisting in holding a paint container that meets these desires.

SUMMARY OF THE INVENTION

It is, therefore, one object of the present invention to provide a holder for assisting in holding a paint container.

It is another object of the present invention to provide a holder for assisting in holding a paint container that is comfortable to a thumb of a person and allows the paint container to be put down quickly.

To achieve the foregoing objects, the present invention is a holder for assisting in holding a paint container. The holder includes a sleeve adapted to receive a thumb of a hand. The holder also includes a retainer connected to the sleeve adapted to retain a handle of a paint container and allow a weight of the paint container to be transferred to a remainder of the hand supporting at the bottom of the paint container.

One advantage of the present invention is that a holder is provided for assisting in holding a paint container with a hand of a person. Another advantage of the present invention is that the holder is comfortable to a thumb of the hand of the person. Yet another advantage of the present invention is that the holder allows a paint container, filled with paint, to be put down quickly, if needed. Still another advantage of the present invention is that the holder allows more paint to be held in the paint container without placing direct pressure on the thumb. A further advantage of the present invention is that the holder avoids any detrimental or damaging effects to the thumb incurred by supporting a heavy paint container by directly hooking the thumb over, under, or around the handle. Yet a further advantage of the present invention is that the holder is relatively inexpensive to make and use, and if damaged, to be replaced relatively quickly and inexpensively.

Other objects, features, and advantages of the present invention will be readily appreciated, as the same becomes better understood, after reading the subsequent description when considered in connection with the accompanying drawings.

DESCRIPTION OF THE PREFERRED EMBODIMENT(S)

Figure 1:
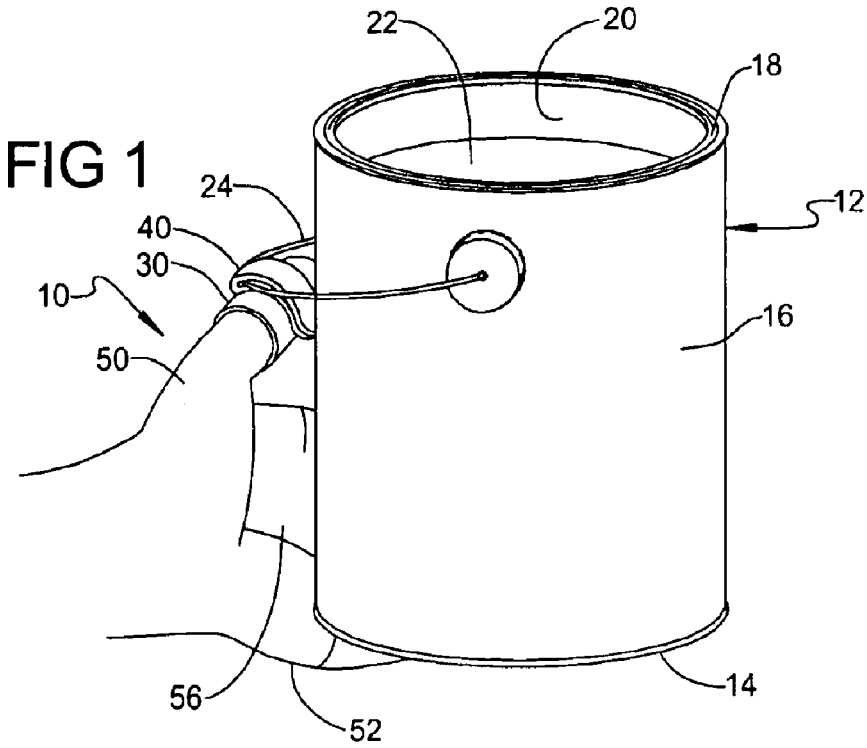
FIG. 1 is a perspective view of a holder, according to the present invention, illustrated in operational relationship with a paint container and a hand of a person.
Figure 2:
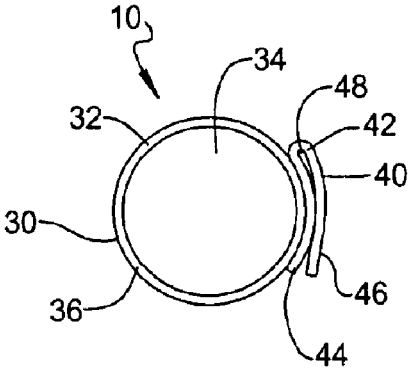
FIG. 2 is a side elevational view of the holder of FIG. 1.
Figure 3:
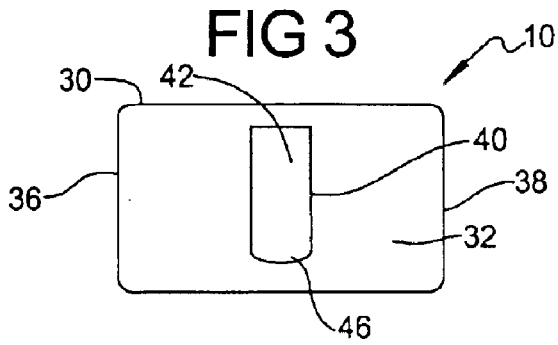
FIG. 3 is a front elevational view of the holder of FIG. 1.
Figure 4:
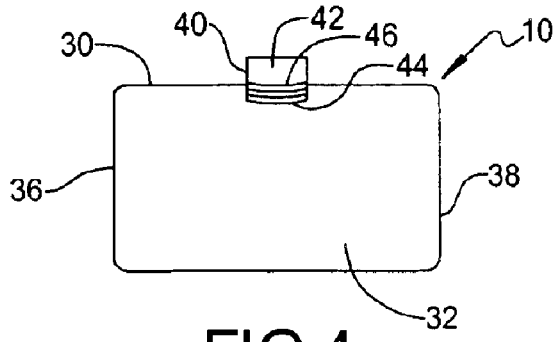
FIG. 4 is a plan view of the holder of FIG. 1.

Referring now to the drawings and in particular to FIG. 1, one embodiment of a holder 10, according to the present invention, is shown for assisting in holding a paint container, generally indicated at 12. The paint container 12 is of a "can" type and includes a closed end or bottom 14, an annular side 16 generally perpendicular to the bottom 14, and an open end or top 18 forming an interior chamber 20 for holding paint 22 therein. The paint container 12 also includes a lid (not shown) for removably closing the open top 18. The paint container 12 further includes a handle 24 having a generally inverted "U" shape pivotally attached to the side 16 by suitable means such as brackets 26. The handle 24 is of a metal wire type. It should be appreciated that the holder 10 is preferably used with a metal one-gallon bucket type of paint container 12, but may be used with other types of pa nt containers or bucket type of paint containers having a handle other than a metal wire type. It should also be appreciated that, except for the holder 10, the paint container 12 is conventional and known in the art.

Referring to FIGS. 1 through 4, the holder 10, according to the present invention, includes a sleeve 30 to receive a thumb of a person. The sleeve 30 is generally cylindrical is shape, but may have any suitable shape, to receive a thumb of a hand of a person. The sleeve 30 has a wall 32 that extends longitudinally to form a hollow interior 34 to receive the thumb. The sleeve 30 follows the length and diameter of the thumb. The sleeve 30 has a first end 36 that is open and a second end 38 that is open. The sleeve 30 may have a height greater than a width thereof and may be concave on opposed sides of the wall 32. The sleeve 30 is made of a flexible material such as vinyl or leather to allow the wall 32 to flex. The sleeve 30 may be made as one continuous unitary niece or as one piece that is attached together at the ends by suitable means such as stitching or two separate pieces attached together by suitable means such as stitching. The sleeve 30 may also be extruded from a plastic material. It should be appreciated that the sleeve 30 may have an interior surface lined with a relative soft material such as foam or cloth. It should also be appreciated that, in another embodiment, the second end 38 may be formed as closed rather than open.

The holder 10 also includes a securing device or retainer 40 for retaining the handle 24 of the paint container 12. The retainer 40 has an inverted and generally "U" shaped wall 42 extending from the sleeve 30 to secure to the handle 24 of the paint container 12. The wall 42 of the retainer 40 has a first end 44 attached to the wall 32 of the sleeve 30 by suitable means such as stitching, an adhesive, or molded as one-piece therewith. The wall 42 of the retainer 40 has a second end 46 that contacts the first end 44 and extends outwardly away from first end 44 to receive the handle 24 therebetween. The retainer 40 is made of a spring material to allow the handle 24 of the paint container 12 to move the second end 46 away from the first end 44 and be disposed in a hollow interior 48 thereof and allow the second end 46 to return to its original position. The retainer 40 has a width less than a width of the sleeve 30. It should be appreciated that the retainer 40, in another embodiment, may have a hook shape or any other suitable shape to grasp the handle 24 of the paint container 12 to act as a hooking or securing device. It should also be appreciated that the retainer 40 may be attached to the sleeve 30 in any suitable manner or be molded as part of the sleeve 30 to be a monolithic structure being integral, unitary, and one-piece. It should further be appreciated that the retainer 40 may be hot glued to the sleeve 30. It should still further be appreciated that a top edge of the retainer 40 is aligned with a central axis of the sleeve 30 or a top of the thumb 50 of a hand 52.

Referring to FIG. 1, in operation, the paint container 12 contains paint 22 in the interior 20. A person inserts a thumb 50 of their hand 52 into the open end 36 of the holder 10. The person moves the holder 10 on the hand 52 toward the handle 24 of the paint container 12 such that the handle 24 is disposed between the first end 44 and second end 46 of the retainer 40. The person moves the holder 10 further such that the second end 46 is deflected by the handle 24 away from the first end 44 and the handle 24 is disposed in the hollow interior 48. The person places a remainder of the hand 52 such as either one or both their other fingers 54 or palm 56 underneath the bottom 14 of the paint container 12 in an "underhand" holding technique. Thus, in holding the paint container 12, the thumb 50 is disposed in the holder 10, the retainer 40 retains the handle 24 of the paint container 12, and the fingers 54 or palm 56 are underneath the paint container 12. In this manner, the weight of the paint 22 in the paint container 12 can be securely held by one hand 52 and the thumb 50 is physically isolated from the handle 24 of the paint container 12 with little direct pressure on it due to the weight or force of the paint 22. As such, more paint can be held in the paint container 12 without placing any additional direct pressure on the thumb 50 while the thumb 50 and holder 10 stabilize the paint container 12. It should be appreciated that the holder 10 is easy, cheap, and allows the paint container 12 to be put down quickly. It should also be appreciated that the holder 10 is ergonomically correct to transfer the weight of the paint 22 to the palm of the hand and allow the thumb to stabilize the paint container 12 when being held by the hand.

Figure 5:
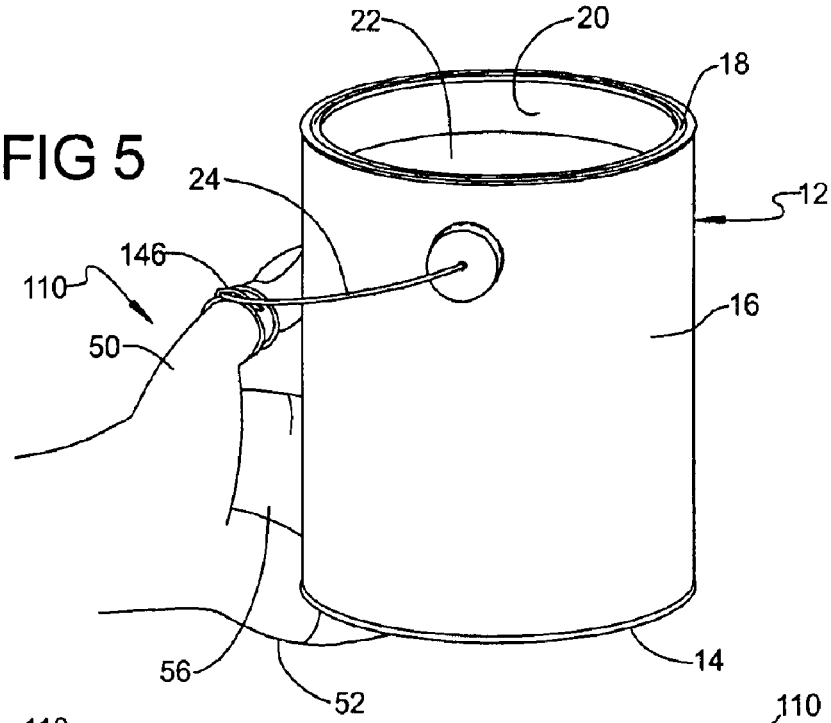
FIG. 5 is a perspective view of another embodiment, according to the present invention, of the holder illustrated in operational relationship with a paint container and a hand of a person.
Figure 6:
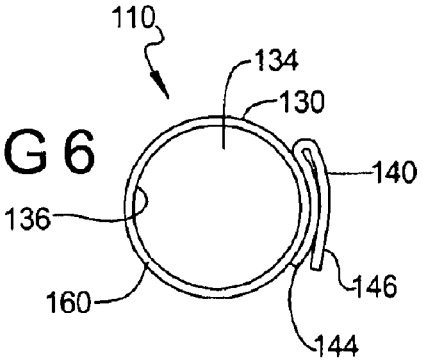
FIG. 6 is a side elevational view of the holder of FIG. 5.
Figure 7:
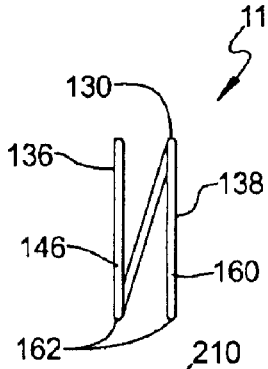
FIG. 7 is a front elevational view of the holder of FIG. 5.

Referring to FIGS. 5 through 7, another embodiment, according to the present invention, of the holder 10 is shown. Like parts of the holder 10 have like reference numerals increased by one hundred (100). In this embodiment, the holder 110 is adapted to be left on or remain on the handle 24 of the paint container 12. The holder 110 is made of a rigid material such as a single metal wire 160 having a plurality of turns 162 to form the sleeve 130 with the hollow interior 134 and the first end 136 and second end 138. The holder 110 also has the retainer 140 formed from the wire 160 with the first end 144 and second end 146. It should be appreciated that the retainer 140 may be attached on or permanently affixed to the handle 24 such that it is left on the handle 24 of the paint container 12 when not in use.

Referring to FIG. 5, in operation, the paint container 12 contains paint 22 in the interior 20. The holder 110 is attached to the handle 24 of the paint container 12 such that the handle 24 is disposed between the first end 144 and second end 146 of the retainer 140. A person inserts a thumb 50 of their hand 52 into the open end 136 of the holder 110. The person places a remainder of the hand 52 such as either one or both their other fingers 54 or palm 56 underneath the bottom 14 of the paint container 12 in an "underhand" holding technique. It should be appreciated that, when the thumb 50 of the hand 52 is removed from the sleeve 130 of the holder 110, the retainer 140 retains the holder 110 to the handle 24. It should also be appreciated that, in another embodiment, the wire 160 may be formed with the sleeve 30 of the holder 10 of FIGS. 1 through 3.

Figure 8:
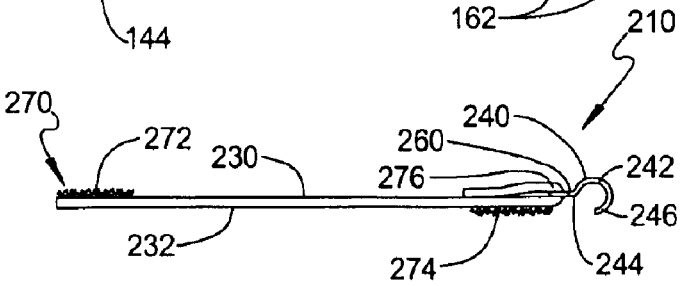
FIG. 8 is a front elevational view of yet another embodiment, according to the present invention, of the holder.
Figure 9:
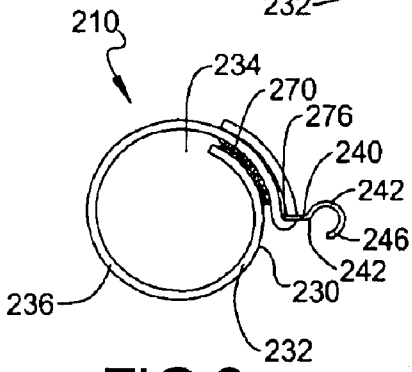
FIG. 9 is a side elevational view of the holder of FIG. 8.
Figure 10:
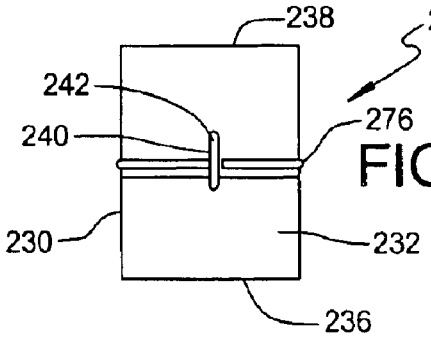
FIG. 10 is a plan view of the holder of FIG. 8.

Referring to FIGS. 8 through 10, yet another embodiment, according to the present invention, of the holder 10 is shown. Like parts of the holder 10 have like reference numerals increased by two hundred (200). In this embodiment, the holder 210 is adapted to be left on or remain on the handle 24 of the paint container 12. The holder 210 may be a strip of material, preferably a flexible material such as cloth, which extends longitudinally to form the wall 232. The holder 210 also has a removable fastener, generally indicated at 270, attached to the wall 232. The fastener 270 is preferably of a Velcro type having a plurality of hooks 272 at one longitudinal end and a plurality of loops 274 at the other longitudinal end. The hooks 272 and loops 274 engage each other such that the wall 232 forms the sleeve 230 with the hollow interior 234 and the first end 236 and second end 238. The holder 210 also has the retainer 240 made from a wire 260 to form the wall 242 with a base 276 wrapped about the wall 232 of the sleeve 230 and the first end 244 and second end 246. It should be appreciated that the retainer 240 may be attached on or permanently affixed to the handle 24 such that it is left on the handle 24 of the paint container 12 when not in use.

In operation, the paint container 12 contains paint 22 in the interior 20. The holder 210 is attached to the handle 24 of the paint container 12 such that the handle 24 is disposed between the first end 244 and second end 246 of the retainer 240. A person inserts a thumb 50 of their hand 52 into the open end 236 of the holder 210. The person places a remainder of the hand 52 such as either one or both their other fingers 54 or palm 56 underneath the bottom 14 of the paint container 12 in an "underhand" holding technique. It should be appreciated that, when the thumb 50 of the hand 52 is removed from the sleeve 230 of the holder 210, the retainer 240 retains the holder 210 to the handle 24. It should also be appreciated that the holder 110 and 210 may be an original equipment manufacturer (OEM) and/or aftermarket product.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A holder for assisting in holding a paint container, comprising:

a cylindrical sleeve adapted to receive a thumb of a hand and having a longitudinal axis; and a retainer having a wall with a first end connected to said sleeve, said first end being fixed relative to said sleeve, said wall having a second end extending generally perpendicular to said longitudinal axis of said sleeve to overlap a circumferential portion of said sleeve, said retainer being adapted to be attached to and detached from a handle of a paint container, whereby the retainer is attached to the handle and the sleeve receives the thumb of the hand to allow a weight of the paint container to be transferred to a remainder of the hand supporting at a bottom of the paint container.

2. A holder as set forth in claim 1 wherein said sleeve is generally tubular in shape.

3. A holder as set forth in claim 1 wherein said sleeve extends longitudinally to form a hollow interior.

4. A holder as set forth in claim 3 wherein said sleeve has at least one open end adapted to allow the thumb of the hand to extend into said hollow interior.

5. A holder as set forth in claim 1 wherein said sleeve is made of a flexible material.

6. A holder as set forth in claim 1 wherein said retainer has a general "U" shape.

7. A holder as set forth in claim 1 wherein said retainer is made of a spring material.

8. A holder as set forth in claim 1 wherein said first end and said second end form a hollow interior therebetween.

9. A holder as set forth in claim 1 wherein said second end is movable relative to said first end.

10. A holder for assisting in holding a paint container, comprising:

a cylindrical sleeve extending longitudinally to form a hollow interior with at least one open end adapted to receive a thumb of a hand, said sleeve being unitary circumferentially; and a retainer having a first end connected to said sleeve and a second end extending generally perpendicular to a longitudinal axis of said sleeve to overlap a portion of said sleeve, said retainer extending from and being unitary and one-piece with said sleeve, said retainer being adapted to be attached to and detached from a handle of a paint container, whereby the retainer is attached to the handle and the sleeve receives the thumb of the hand to allow a weight of the paint container to be transferred to a remainder of the hand supporting a bottom of the paint container.

11. A holder as set forth in claim 10 wherein said sleeve is made of a flexible material.

12. A holder as set forth in claim 10 wherein said retainer has a general "U" shape.

13. A holder as set forth in claim 10 wherein said retainer is made of a spring material.

14. A holder as set forth in claim 10 wherein said second end is movable relative to said first end.

15. A holder comprising:

a cylindrical sleeve having a wall extending longitudinally to form a hollow interior with at least one open end adapted to receive a thumb of a hand; and a retainer having a first end extending from said wall of said sleeve and a second end extending generally perpendicular to a longitudinal axis of said sleeve to overlap a portion of said sleeve, said sleeve and retainer being made of a plastic material to form a monolithic structure that is unitary and one-piece, said retainer being adapted to be attached to and detached from a handle of a paint container, whereby the retainer is attached to the handle and the sleeve receives the thumb of the hand to allow a weight of the paint container to be transferred to a remainder of the hand supporting a bottom of the paint container.

* * * * *